US006835880B1

(12) United States Patent
Silva

(10) Patent No.: US 6,835,880 B1
(45) Date of Patent: Dec. 28, 2004

(54) GUITAR FRETBOARD CAPO

(75) Inventor: Lowell Thomas Silva, San Pablo, CA (US)

(73) Assignee: Dunlop Manufacturing, Inc., Benicia, CA (US)

( * ) Notice: Subject to any disclaimer, the term of this patent is extended or adjusted under 35 U.S.C. 154(b) by 34 days.

(21) Appl. No.: 10/606,613

(22) Filed: Jun. 26, 2003

(51) Int. Cl.[7] ..... G10D 3/00
(52) U.S. Cl. ..... 84/318; 84/315
(58) Field of Search ..... 84/318, 315, 316–317

(56) References Cited

U.S. PATENT DOCUMENTS

| | | | | |
|---|---|---|---|---|
| 4,183,279 A | * | 1/1980 | Shabram, Jr. | 84/318 |
| 4,250,790 A | | 2/1981 | Shubb et al. | |
| 5,016,514 A | * | 5/1991 | Kaufman | 84/318 |
| 5,792,969 A | | 8/1998 | Shubb et al. | |
| 6,008,441 A | | 12/1999 | Steinberger | |
| 6,410,832 B1 | * | 6/2002 | Sterner | 84/318 |

* cited by examiner

*Primary Examiner*—Kimberly Lockett
(74) *Attorney, Agent, or Firm*—Robert Charles Hill

(57) ABSTRACT

A C-clamp capo comprises a string press for clamping down on the strings of a string-instrument against a front side of a fretboard. An extension arm curves behind and has an idler clamp with a first pivot attachment. Such enables a clamping action against a backside of the fretboard. A continuous insert having a positioning bumper that ensures consistent positioning against the fretboard is disposed all along an inside surface of the string press from a distal end across the first pivot attachment bridging over to an inside surface of the idler clamp and out to its distal end. A locking lever has a second pivot attachment to the extension arm behind the first pivot attachment, and provides a locking action against a backside of the idler clamp. A setscrew disposed in the locking lever provides an adjustable locking action between the idler clamp and the locking lever, e.g., for a range of thicknesses of the fretboard to be accommodated. A plastic, pointed tip on a distal end of the setscrew helps for a smooth engagement along a backside of the idler clamp. A grooved slot in the backside of the idler clamp provides a track in which the plastic, pointed tip of the setscrew is smoothly guided into a locking position. A depression located at a locking end of the grooved slot provides for a detent in the locking position.

12 Claims, 3 Drawing Sheets

Fig. 2
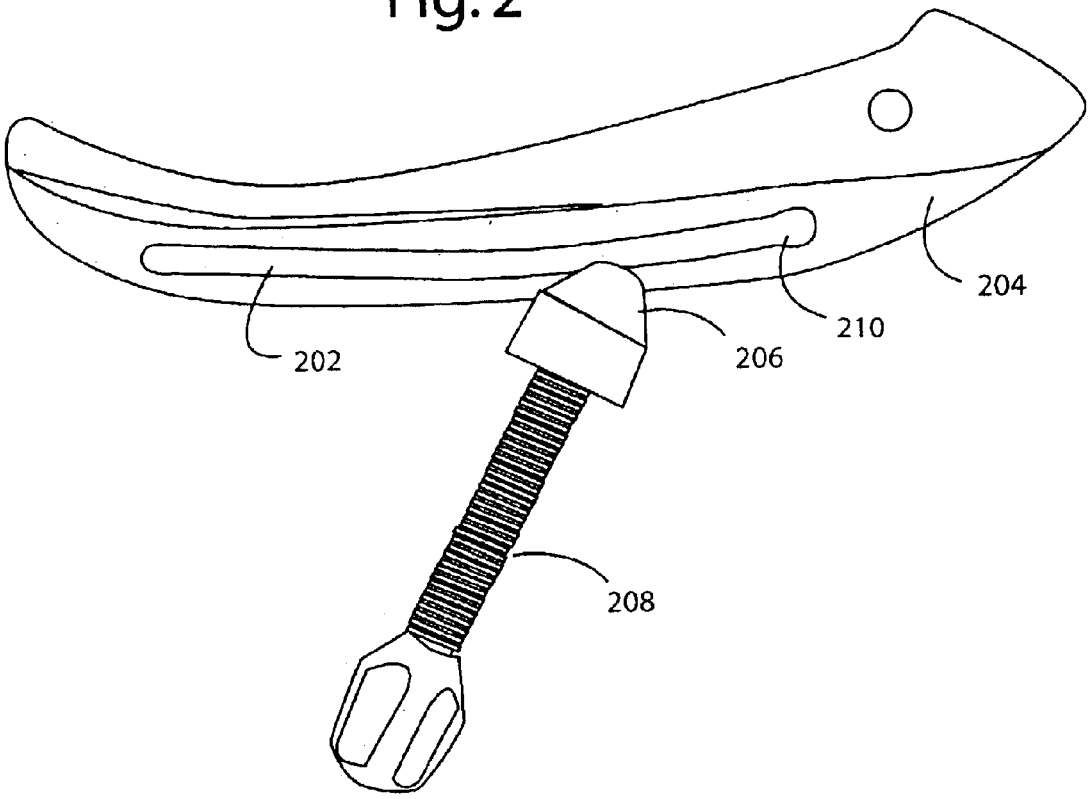
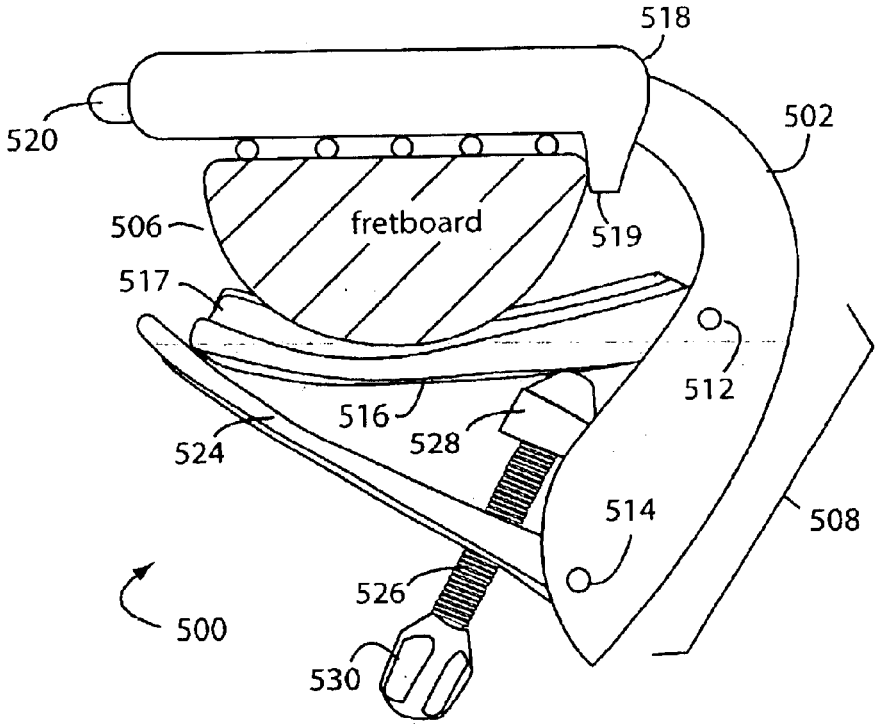
Fig. 5

GUITAR FRETBOARD CAPO

FIELD OF THE INVENTION

The present invention relates to stringed-instrument fretboard capos, and more specifically to guitar and banjo capos that are easy to clip-on and remove, and that protect the instrument fretboard from being damaged during its installation and removal.

BACKGROUND OF THE INVENTION

Capotastos are used by musicians who play guitars and banjos to make it easier to change music keys. In effect, a "capo" will simultaneously finger all the strings at a single fret as long as the capo is secured in place. This therefore sets the half-notes sounded when the open strings are strummed. Playing the guitar, banjo, or lute, is therefore highly simplified without compromising the original composition. Capos are in widespread use as a result, and there are many screw-down and clamp-down versions being sold commercially.

One particular type of capo is a levered clamp with separate rubber linings on the inside of the two jaws, commonly called a "C-clamp" capo. Richard Shubb describes such a capo in U.S. Pat. No. 4,250,790, issued Feb. 17, 1981, (Shubb '790). A frame with a straight rubber facing is clamped down tight over the strings of a guitar and pulls them against the fretboard. An idler clamp with a concave curve and a short rubber facing presses from behind the fretbbard. A locking lever with a setscrew rides over a hump on the back of the idler clamp and is able to lock the idler clamp tight. The setscrew allows for some adjustment of the pressure and allows a range of fretboard thicknesses to be accommodated. The placement of the rubber linings allows the fretboard to be marred by exposed metal in the capo. And the setscrew tends to gouge the backside of the idler clamp such that the action is no longer very smooth. Experience has shown that the commercial units sold like this also tend to pull away from the strings. Such capo was improved by Richard Shubb, and is described by him in U.S. Pat. No. 5,792,969, issued Aug. 11, 1998, (Shubb '969). The basic form is maintained from Shubb '790, but an idler wheel is provided between the setscrew end and the backside of the idler clamp to relieve friction and gouging when the clamp is locked. A large knurled head is shown on the outside end of the setscrew to make it easier for the user to adjust the clamping range. Shubb '969 shows the rubber facing on the "top arm 7" as fully wrapping around the distal end. There is still a large exposed metal area inside the jaws, e.g., around the "roll pin 39", that can contact and mar the users' fretboards.

A different approach to locking a capo down on a fretboard is described by Richard Steinberger in U.S. Pat. No. 6,008,441, issued Dec. 28, 1999. The idler clamp is fitted with a spring that presses the jaws closed around the fretboard. A release lever is linked to force the idler clamp jaws open when it is squeezed together by hand with a stationary lever on the frame. A problem with prior art "C-clamp" type capos is that they tend to move across the strings and pull them out of tune, especially when being clamped on. There is a slight decrease in the applied pressure when the adjustment tip rotates past its top-dead-center and comes back in a bit. Such "overstretched knee effect" seems to be inherent in conventional capos.

SUMMARY OF THE INVENTION

An object of the present invention is to provide a capo that grips the fretboard and strings firmly.

Another object of the present invention is to provide a capo that will not mar a fretboard.

A further object of the present invention is to provide a capo with a positioning bumper that ensures consistent positioning against the fretboard.

Briefly, a capo embodiment of the present invention comprises a string press for clamping down on the strings of a string-instrument against a front side of a fretboard. An extension arm curves behind and has an idler clamp with a first pivot attachment. Such enables a clamping action against a backside of the fretboard. A continuous insert having a positioning bumper maybe disposed all along an inside surface of the string press from a distal end across the first pivot attachment bridging over to an inside surface of the idler clamp and out to its distal end. The positioning bumper may also be on an insert disposed on the inside surface of the string press or on the inside surface of the idler clamp. A locking lever has a second pivot attachment to the extension arm behind the first pivot attachment. It provides a locking action against a backside of the idler clamp. A setscrew disposed in the locking lever provides an adjustable locking action between the idler clamp and the locking lever, e.g., for a range of thicknesses of the fretboard to be accommodated. A plastic, pointed tip on a distal end of the setscrew helps for a smooth engagement along a backside of the idler clamp. A grooved slot in the backside of the idler clamp provides a track in which the plastic, pointed tip of the setscrew is smoothly guided into a locking position. A depression located at a locking end of the grooved slot provides for a detent in the locking position.

An advantage of the present invention is that a capo is provided that grips the fretboard and strings firmly without detuning the instrument.

Another advantage of the present invention is that a capo is provided that will ensure consistent positioning against the fretboard.

A further advantage of the present invention is that a capo is provided that is simple to use.

These and other objects and advantages of the present invention will no doubt become obvious to those of ordinary skill in the art after having read the following detailed description of the preferred embodiment as illustrated in the drawing figures.

DESCRIPTION OF THE DRAWINGS

FIG. 2 is a perspective diagram of the capo of FIGS. 1A and 1B detailing the pointed tip of the setscrew and its track and the detent it follows on the backside of the idler clamp;

FIG. 5 is a side view diagram of a fourth capo embodiment of the present invention in its closed, locked position, and showing the positioning bumper on cylindrical pad that slips over the distal end of the string press.

DETAILED DESCRIPTION OF THE EMBODIMENTS

Figure 1A:
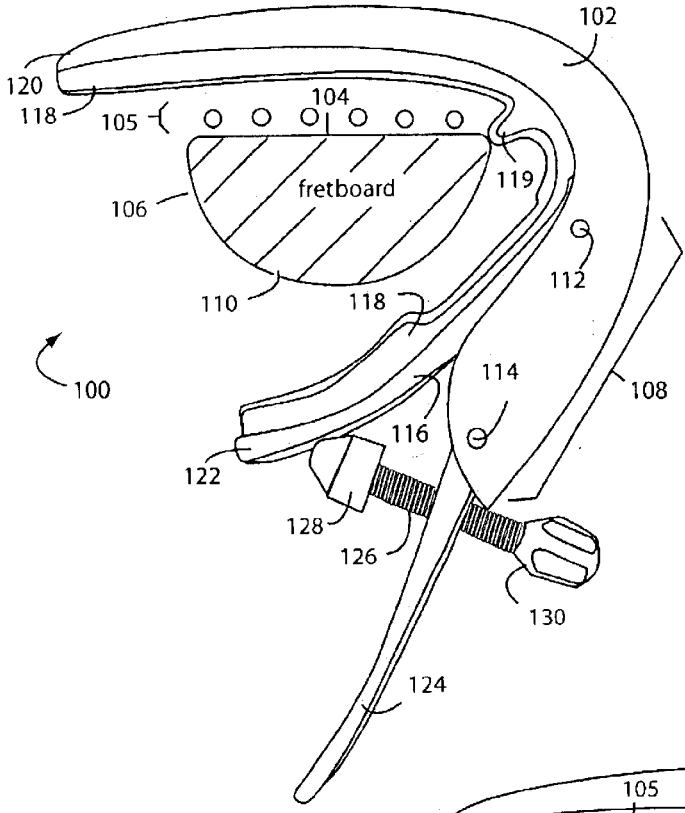
FIG. 1A is a side view diagram of a first capo embodiment of the present invention having a continuous insert in its open, unlocked position, and with a fretboard in cross section with the strings released.
Figure 1B:
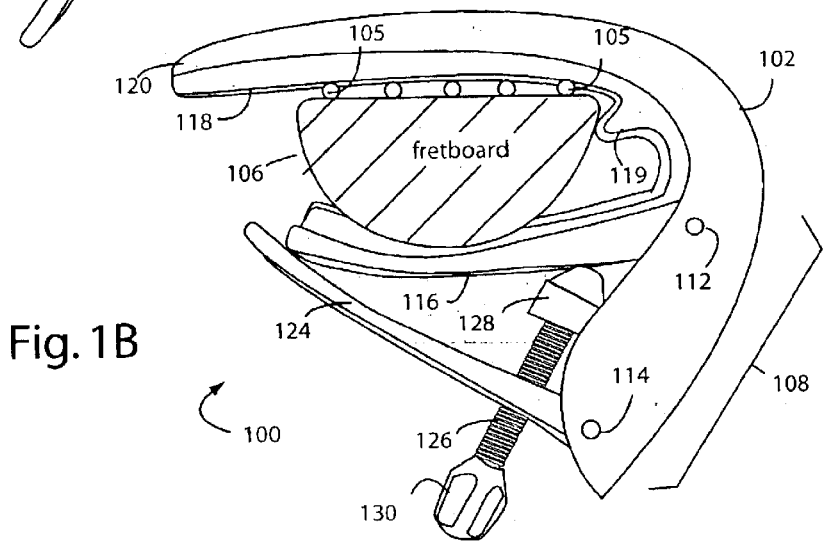
FIG. 1B is a side view diagram of the capo of FIG. 1A in its closed, locked position, and showing the strings being clamped tight against the fretboard and the positioning bumper ensuring consistent positioning against the fretboard.

FIGS. 1A and 1B illustrate a C-clamp type capo embodiment of the present invention, and such is referred to herein by the general reference numeral 100. The capo 100 comprises a string press 102 that provides for a clamping down of the strings against a front side 104 and strings 105 of a fretboard 106 of a string-instrument. An extension arm 108 curves behind a backside 110 of fretboard 106, and has two pivot points, 112 and 114. An idler clamp 116 has a first pivot attachment to the extension arm at pivot 112. It provides for a clamping action against backside 110 of fretboard 106.

A continuous insert 118 includes a positioning bumper 119 that limits how deep the capo 100 can be clamped around the fretboard 106. The positioning bumpers included in embodiments of the present invention all perform a critical role in preventing the capo from slipping during clamping, and they ensure consistent positioning against the fretboard. The positioning bumpers extend out about 0.25–0.30 inches from the insert.

The insert 118 is preferably made of a resilient material with a Durometer of about 50–70, e.g., neoprene, gum rubber, etc. The continuous insert 118 is disposed all along an inside surface of the string press 102 from a distal end 120 to past first pivot attachment 112, and bridges over to be disposed all along an inside surface of the idler clamp 116 out to its distal end 122. In preferred embodiments, the bodies of string press 102 and idler clamp 116 are cupped to allow the capture and secure alignment of the continuous insert 118.

A locking lever 124 with the second pivot attachment 114 to the extension arm 108 swings outside the first pivot attachment 112. This provides for a locking action against a backside of the idler clamp 116.

A setscrew 126 is disposed in the locking lever 124 and provides for an adjustable locking action between the idler clamp 116 and the locking lever 124. The lever 124 pivots around pivot point 114 until it is stopped by tip 128 going past top-dead-center or a few degrees past the point of maximum pressure.

Different positions of the setscrew 126 provide for a range of thicknesses of fretboard 106 to be accommodated and clamping pressures. A plastic, pointed tip 128 is disposed on a distal end of the setscrew 126 and provides for a smooth engagement along a backside of the idler clamp 116. A knob 130 is provided to make finger and thumb adjustments more comfortable for the user.

As shown more fully in FIG. 2, a grooved slot 202 is disposed in the backside of an idler clamp 204, e.g., like idler clamp 116 in FIGS. 1A and 1B. It provides a track in which a plastic, pointed tip 206 of setscrew 208 (as in capo 100 of FIGS. 1A and 1B) is guided into a locking position, e.g., as in FIG. 1B. A depression 210 is located at a locking end of the grooved slot 202, and provides for a detent of the plastic, pointed tip 206 into such locking position.

Figure 3:
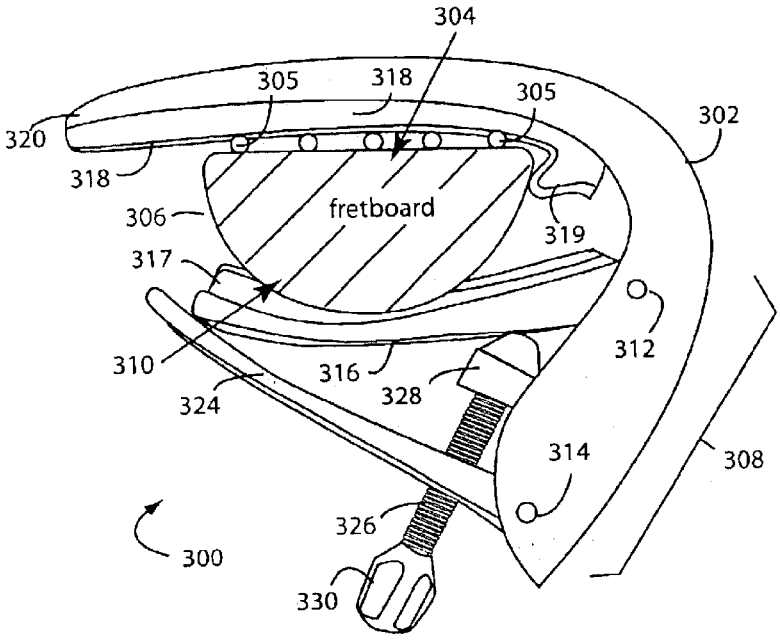
FIG. 3 is a side view diagram of a second capo embodiment of the present invention in its closed, locked position, and showing the positioning bumper on the insert disposed on the inside surface of the string press.

FIG. 3 illustrates a second capo embodiment of the present invention, and such is referred to herein by the general reference numeral 300. It is similar to construction and use of capo 100 (FIG. 1). The capo 300 comprises a string press 302 that provides for a clamping down of the strings against a front side 304 and strings 305 of a fretboard 306 of a string-instrument. An extension arm 308 curves behind a backside 310 of fretboard 306, and has two pivot points, 312 and 314. An idler clamp 316 has a first pivot attachment to the extension arm at pivot 312.

It provides for a clamping action against backside 310 of fretboard 306.

A first insert 317 presses against the backside 310 of fretboard 306. A second insert 318 includes a positioning bumper 319 that limits how deep the capo 300 can be clamped around the fretboard 306. Inserts 317 and 318 are preferably made of a resilient material with a Durometer of 50–70, e.g., neoprene, gum rubber, etc. In preferred embodiments, the bodies of string press 302 and idler clamp 316 are cupped to allow the capture and secure alignment of the inserts 317 and 318. The insert 318 extends out to a distal end 320.

A locking lever 324 with the second pivot attachment 314 to the extension arm 308 swings-outside the first pivot attachment 312. This provides for a locking action against a backside of the idler clamp 316.

A setscrew 326 is disposed in the locking lever 324 and provides for an adjustable locking action between the idler clamp 316 and the locking lever 324. Different positions of the setscrew 326 provide for a range of thicknesses of fretboard 306 to be accommodated. A plastic, pointed tip 328 is disposed on a distal end of the setscrew 326 and provides for a smooth engagement along a backside of the idler clamp 316. A knob 330 is provided to make finger and thumb adjustments more comfortable for the user.

Figure 4:
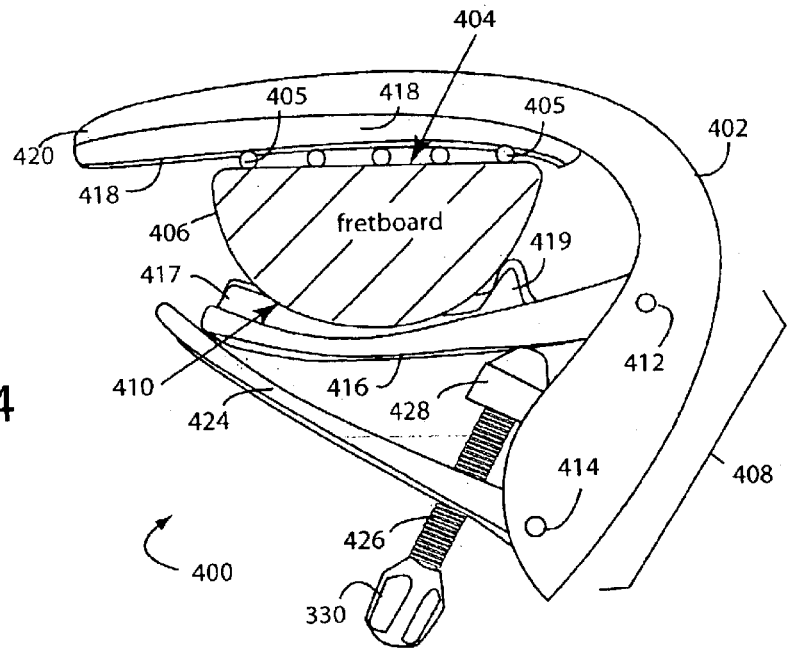
FIG. 4 is a side view diagram of a third capo embodiment of the present invention its closed, locked position, and showing the positioning bumper on the insert disposed on the inside surface of the idler clamp.

FIG. 4 illustrates a third capo embodiment of the present invention, and is referred to herein by the general reference numeral 400. It is similar to construction and use of capo 100 (FIG. 1). The capo 400 comprises a string press 402 that provides for a clamping down of the strings against a front side 404 and strings 405 of a fretboard 406 of a string-instrument. An extension arm 408 curves behind a backside 410 of fretboard 406, and has two pivot points, 412 and 414. An idler clamp 416 has a first pivot attachment to the extension arm at pivot 412. It provides for a clamping action against backside 410 of fretboard 406.

A first insert 417 presses against a backside 410 of the fretboard 406. A second insert 418 presses against the strings 405. The inside end of the first insert 417 includes a positioning bumper 419 that limits how deep the capo 400 can be clamped around the fretboard 406. Inserts 417 and 418 are preferably made of a resilient material with a Durometer of 50–70, e.g., neoprene, gum rubber, etc. In preferred embodiments, the bodies of string press 402 and idler clamp 416 are cupped to allow the capture and secure alignment of the inserts 417 and 418. The insert 418 extends out to a distal end 420.

A locking lever 424 with the second pivot attachment 414 to the extension arm 408 swings outside the first pivot attachment 412. This provides for a locking action against a backside of the idler clamp 416. A setscrew 426 is disposed in the locking lever 424 and provides for an adjustable locking action between the idler clamp 416 and the locking lever 424. Different positions of the setscrew 426 provide for a range of thicknesses of fretboard 406 to be accommodated. A plastic, pointed tip 428 is disposed on a distal end of the setscrew 426 and provides for a smooth engagement along a backside of the idler clamp 416. A knob 430 is provided to make finger and thumb adjustments more comfortable for the user.

FIG. 5 illustrates a fourth capo embodiment of the present invention, and is referred to herein by the general reference numeral 500. It is similar to construction and use of capo 100 (FIG. 1). The capo 500 comprises a string press 502 that provides for a clamping down of strings 505 to a fretboard 506 of a string-instrument. An extension arm 508 curves behind a backside of fretboard 506, and has two pivot points, 512 and 514. An idler clamp 516 has a first pivot attachment to the extension arm at pivot 512. It provides for a clamping action against backside of fretboard 506.

An insert 517 presses against a backside of the fretboard 506. A cylindrical pad 518 presses against the strings 505. The inside end of the cylindrical pad 518 includes a positioning bumper 519 that limits how deep the capo 500 can be clamped around the fretboard 506. The pad 518 is slipped over a distal end 520. Insert 517 and pad 518 are preferably made of a resilient material with a Durometer of 50–70, e.g., neoprene, gum rubber, etc. A locking lever 524 with the second pivot attachment 514 to the extension arm 508 swings outside the first pivot attachment 512. This provides for a locking action against a backside of the idler clamp 516. A setscrew 526 is disposed in the locking lever 524 and provides for an adjustable locking action between the idler clamp 516 and the locking lever 524. Different positions of the setscrew 526 provide for a range of thicknesses of fretboard 506 to be accommodated. A plastic, pointed tip 528 is disposed on a distal end of the setscrew 526 and provides for a smooth engagement along a backside of the idler clamp 516. A knob 530 is provided to make finger and thumb adjustments more comfortable for the user.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A C-clamp capo, comprising:

a string press for providing a clamping down of strings against a front side of a fretboard of a string-instrument, and having an extension arm that curves behind;

an idler clamp with a first pivot attachment to said extension arm, and for providing a clamping action against a backside of said fretboard;

a first insert disposed along an inside surface of the string press;

a second insert disposed along an inside surface of the idler clamp;

a positioning bumper disposed on one inside end of either the first or second insert and providing for a consistent depth of engagement between the capo and said fretboard of said string-instrument; and a locking lever with a second pivot attachment to said extension arm behind said first pivot attachment, and for providing a locking action against a backside of said idler clamp.

2. The C-clamp capo of claim 1, wherein:

the positioning bumper extends out about 0.25–0.30 inches from said insert.

3. The C-clamp capo of claim 1, wherein:

the inserts are a resilient material with a Durometer of about 50–70.

4. A C-clamp capo, comprising:

a string press for providing a clamping down of strings against a front side of a fretboard of a string-instrument, and having an extension arm that curves behind;

an idler clamp with a first pivot attachment to said extension arm, and for providing a clamping action against a backside of said fretboard;

a continuous insert that is disposed all along an inside surface of the string press from a distal end to said first pivot attachment, and that bridges over and is disposed all along an inside surface of the idler clamp out to its distal end;

a positioning bumper disposed on an inside corner of continuous insert and providing for a consistent depth of engagement between the capo and said fretboard of said string-instrument; and a locking lever with a second pivot attachment to said extension arm behind said first pivot attachment, and for providing a locking action against a backside of said idler clamp.

5. The C-clamp capo of claim 4, further comprising:

a setscrew disposed in the locking lever and providing for an adjustable locking action between the idler clamp and the locking lever, and that provides for a range of thicknesses of said fretboard to be accommodated.

6. The C-clamp capo of claim 5, further comprising:

a plastic, pointed tip disposed on a distal end of the setscrew and providing for a smooth engagement along a backside of the idler clamp.

7. The C-clamp capo of claim 4, further comprising:

a grooved slot disposed in said backside of the idler clamp, and providing for a track in which the plastic, pointed tip on a distal end of the setscrew is guided into a locking position.

8. The C-clamp capo of claim 7, further comprising:

a depression located at a locking end of the grooved slot, and providing for a detent of the plastic, pointed tip into said locking position.

9. The C-clamp capo of claim 4, wherein:

the positioning bumper extends out 0.25–0.30 inches from said insert.

10. The C-clamp capo of claim 4, wherein:

the continuous insert is a resilient material with a Durometer of about 50–70.

11. A capo, comprising:

a string press for providing a clamping down of strings against a front side of a fretboard of a string-instrument, and having an extension arm that curves behind;

an idler clamp with a first pivot attachment to said extension arm, and for providing a clamping action against a backside of said fretboard;

a resilient pad disposed around a part of the string press;

a resilient insert disposed along an inside surface of the idler clamp;

a positioning bumper disposed on an inside end of the resilient pad and providing for a consistent depth of engagement between the capo and said fretboard of said string-instrument; and a locking lever with a second pivot attachment to said extension arm behind said first pivot attachment, and for providing a locking action against a backside of said idler clamp.

12. The capo of claim 11, wherein:

the resilient pad is in the form of a sleeve that is slipped over the string press.

* * * * *